United States Patent [19]

Spinner

[11] 4,285,564

[45] Aug. 25, 1981

[54] HF COAXIAL PLUG CONNECTOR

[76] Inventor: Georg Spinner, Am Eichberg 12, 8152 Feldkirchen-Westerham 1, Fed. Rep. of Germany

[21] Appl. No.: 76,062

[22] Filed: Sep. 17, 1979

[30] Foreign Application Priority Data

Sep. 19, 1978 [DE] Fed. Rep. of Germany ..... 2840728

[51] Int. Cl.[3] ..... ..... H01R 13/639

[52] U.S. Cl. ..... 339/89 C; 339/91 P

[58] Field of Search ..... 285/81–90; 339/88 R–91 P, 136, 177 R, 177 E, 45 R, 45 M, 113 R

[56] References Cited

U.S. PATENT DOCUMENTS

| | | | |
|---|---|---|---|
| 2,728,895 | 12/1955 | Quackenbush et al. | 785/81 X |
| 2,784,385 | 3/1957 | Ennis | 339/136 M X |
| 2,829,358 | 4/1958 | Testori | 339/89 M X |
| 3,517,371 | 6/1970 | Buckley | 339/89 C |

*Primary Examiner*—Eugene F. Desmond

*Attorney, Agent, or Firm*—Ostrolenk, Faber, Gerb & Soffen

[57] ABSTRACT

A coupling device for coupling a jack connector and a plug connector is disclosed. One connector is externally threaded and the second is provided with an internally threaded cap nut. A cap ring is mounted on the cap nut so that rotation of the ring rotates the cap nut in the same direction. A first ring of axially pointed rigid teeth is provided around the circumference of the cap ring or on a separate sleeve. The first connector has another ring with at least one rigid axially mounted tube for engaging the first tooth ring. For connection the cap nut is screwed onto the first connector. The teeth are shaped to pass over each other easily as the cap is screwed on. To facilitate connection the cap ring is withdrawn axially, against the force of a biasing spring, while the cap nut is screwed on. Then the cap ring is released and the spring urges it into locking engagement with the other tooth ring. Accidental rotation of the cap nut relative to the other connector is prevented, so that accidental loosening is impossible.

13 Claims, 4 Drawing Figures

HF COAXIAL PLUG CONNECTOR

This invention relates to an HF plug connector of the type including a pin plug connector and a jack connector, one of which has a cap nut and the other of which has an external thread onto which the cap nut can be screwed, and in which the cap nut is provided with an anti-turning device comprising two radially sawtoothed rings that can be brought into locking engagement with each other when the connector is in the connected condition. One of the rings is disposed on the cap nut and the other on the plug connector. When they are in locking engagement, they are prevented at least from turning in the locking direction. The ring disposed on the cap nut is axially disengageable against a spring force.

Such a plug connection is known from German Unexamined Application for Patent No. 21 36 500. In that case the cap ring is connected with the externally threaded plug part and its toothing cooperates with a toothed ring which protrudes at the end side from the cap nut. This plug connector assures dependable security against turning and easy screwing-on, in which connection either the tooth flanks of the two toothed rims can travel on each other or the cap ring can be locked in pushed-back position by a bayonet lock in order to permit free screwing-on and after the tightening of the cap nut the cap ring can be brought into blocking engagement by the opening of the interlock.

The object of the invention is to further improve an HF plug connector of the aforementioned type in such a manner that with a simplified construction the ease of operation is increased.

This purpose is achieved by the features indicated in the body of Claim 1. Due to the fact that the cap ring is combined with the cap nut, a convenient one-hand operation is possible even for the opening of the connection since the cap ring can be simultaneously pushed back and turned without any interlocking possibility being necessarily provided for this. In particular, however, the invention provides the advantage that all traditional plug connectors can be used without modification since the security against turning is arranged merely in the cap nut or a toothed ring which can be placed on the mating plug connector. In the known plug connection it was necessary to equip the plug connector bearing the cap ring with a guide which assured non-turning movement of the cap ring relative to the plug connector. The toothed ring provided in accordance with the invention and which can be used alternately as an individual part can be so developed that it is adapted to the specific plug connector and can be fastened with it to the continuing plug part or a housing, in which connection, particularly for appliance connections, the toothed ring can be provided with a flange which corresponds to the plug connector flange so that the two flanges can be fastened by the screws to the apparatus housing.

Further developments of the invention can be noted from the subordinate claims.

Two illustrative embodiments of the invention will be described below with reference to the drawing, in which FIG. 1 shows an HF coaxial plug connector having a plug connector provided with cap nut and an externally threaded plug connector which cooperates with same, shown in partial section in unplugged condition.

FIG. 4 is a partial sectional view of another embodiment of the cap nut with automatic loosening of the interlock engagement upon screwing-on.

Figure 1:
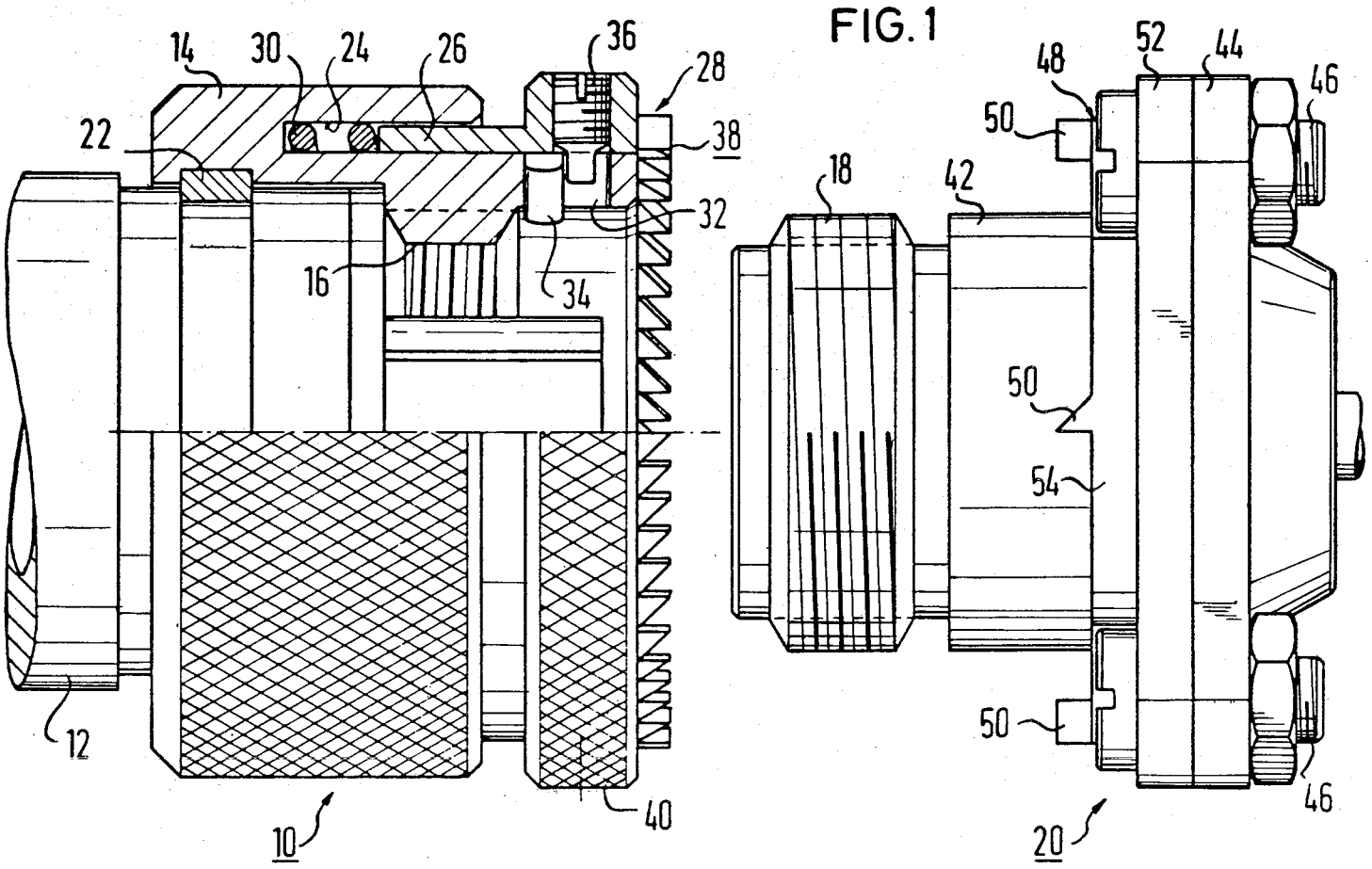

The plug connector 10 shown to the left in FIG. 1 can be connected to a cable by its plug body 12 and has a cap nut 14 which by an internal thread 16 can be screwed onto an external thread 18 of the other plug connector 20 which is developed, for instance, as housing connection. For the invention it is immaterial which of the two parts is developed as pin plug and which as jack or how the plug connection of outer and inner conductors is effected in detail. The cap nut 14 is connected with the plug body 12 in turnable fashion out it is fixed in axial direction by a snap ring 22 which engages in an inner groove of the cap nut 14 and an outer groove in the plug body 12. The cap nut 14 has an axial groove 24 which is open towards the connection side and within which a sleeve extension 26 of a cap ring 28 is slidably guided. This cap ring 28 is normally urged towards the outside, i.e. to the right in FIG. 1, by a compression coil spring 30.

The cap nut is provided with an L-shaped groove which has an axial section 32 and a section 34 which extends in circumferential direction. A stud screw 36 of the cap ring extends into this groove. By its axial section 32 the cap ring 28 is guided in non-rotatable but axially displaceable manner with respect to the cap nut 14. After reaching the groove 34 which extends in circumferential direction the cap ring 28 can be turned a limited amount so that it is held in backward pushed position in the manner of a bayonet closure, i.e. in the position pushed towards the left as seen in FIG. 1.

The cap ring bears an axially toothed ring 38 with sawteeth the flat flanks of which drop away in the direction of fastening while the steeper flanks point in the backward turning direction. The cap ring 28 is provided with a grip knurling 40 for the better grasping thereof. The plug connector 20 has the plug body 42 provided with external threads and a fastening flange 44 which is of square shape and is provided in customary manner at its four corners with passage holes for attachment screws 46. As mating toothing for the toothing 38 of the cap ring a toothed ring 48 is arranged on the plug connector 20. The teeth 50 of this toothed ring could be developed integral with the plug body 42. In accordance with the preferred embodiment of the invention, shown in FIG. 1, a loose toothed ring 48 is, however, employed which can be placed on commercial plug connectors 20 and locked to same without any change in the plug connector 20 itself being necessary. For this purpose the toothed ring has a flange 52 which corresponds to the flange 44 and has passage holes at its corners and a ring 54 integral therewith which bears the teeth 50 and the axial length of which is equal to or greater than the length of the head of the screws 46 by which the flange 52 is connected with the flange 44 (and simultaneously with the appliance, not shown). In accordance with the illustrative embodiment, four sawteeth 50 arranged 90° apart from each other are provided. Instead of this there could also be provided a circumferential radial toothed ring or a greater or lesser number of individual teeth 50 could be provided.

After the plugging together of the two plug connectors 10 and 20, the cap nut 14 is tightened in customary fashion, the teeth 38 and 50 thereby coming into engagement after a certain angle of rotation, in which connection, however the ring 28, being raised in the direction of tightening the cap ring, is in each case raised over the flat flanks while the steep flanks effect the positively locked support in the opposite direction. As soon as the cap nut has been tightened, there is obtained an automatic lock against backward rotation since the radial toothings are held in engagement by the spring 30.

The screwing on of the cap nut can, of course, also be effected with the cap ring in pushed-back position, the teeth not coming into engagement during the screwing on. After the screwing-on the cap ring can then be unlocked with respect to the sleeve so that the spring tension can enter into action. Should it appear advisable to releive the operator from the unlocking work necessary in this connection and nevertheless to assure an engagement of the anti-turning lock the circumferential-groove section 34 can also be dispensed with.

In order to produce the anti-turning lock there is merely necessary a cap nut which is developed in a specific manner and which is held together with a cap ring 28 which cooperates with a toothed ring 48 which can be combined, as an individual part with a plug connector which is developed in customary manner. The plug connectors themselves do not require any modification so that the anti-turning lock in accordance with the invention can be used for all conventional plug connections available on the market which operate with a cap nut.

Figure 2:
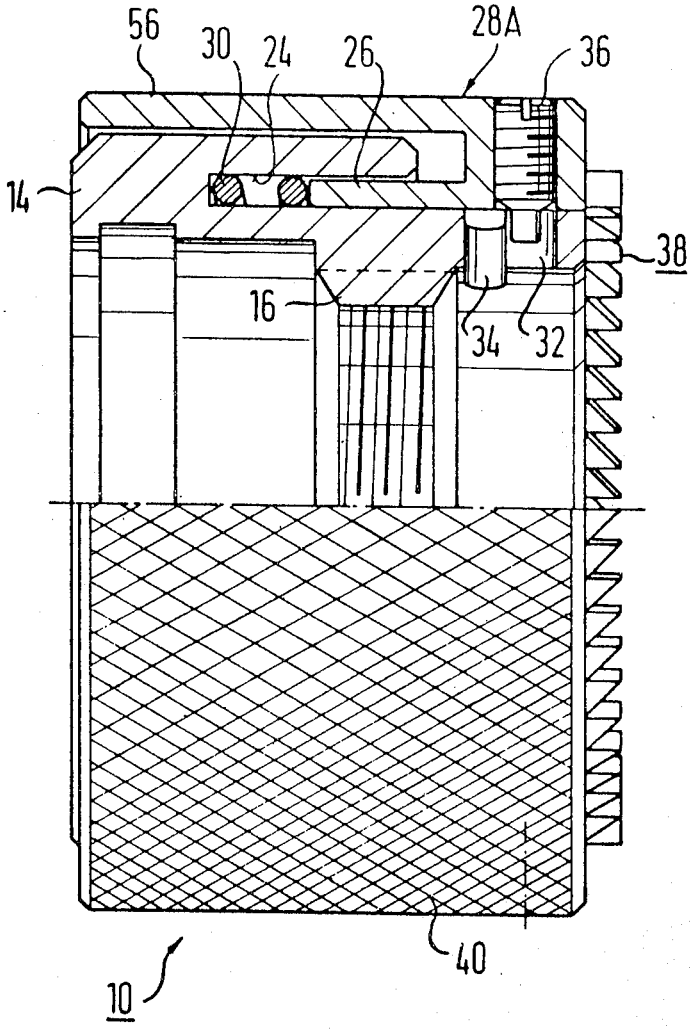
FIG. 2 is a partial sectional view through a modified embodiment of the plug connector provided with cap nut.

FIG. 2 shows another embodiment of a plug connector 10 which differs from the plug connector of FIG. 1 by the fact that the cap ring 28A in addition to the inner sleeve extension 26 by which it is guided in the axial annular groove 24 of the cap nut 14 has a second outer sleeve extension 56 which surrounds the cap nut. This embodiment is particularly advantageous if, upon tightening the cap ring is to be pulled back against the spring force, but the embodiment presupposes that the entire torque must be transmitted from the cap ring to the cap nut so that the provision of several grub screws 36 or other guide means may be necessary.

Figure 3:
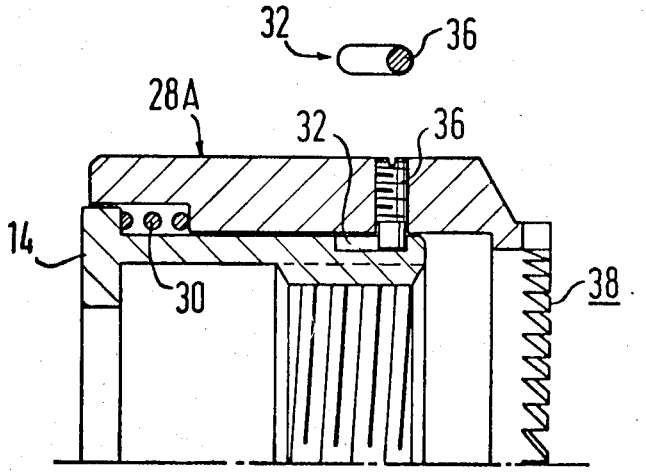
FIG. 3 is a partial section through a modified embodiment of the cap nut with cap ring which is displaceable only axially with respect to same.

In the embodiment shown in FIG. 3, the groove guiding the grub screw 36 has only an axial section 32 so that the cap ring 28 can only be axially displaced but not locked in the retracted position. In this case in order to loosen the connection it is necessary to pull continuously on the cap ring 28. On the other hand, the manufacture is substantially simpler since it is possible to dispense with the circumferentially extending groove part 34 shown in FIGS. 1 and 2.

Figure 4:
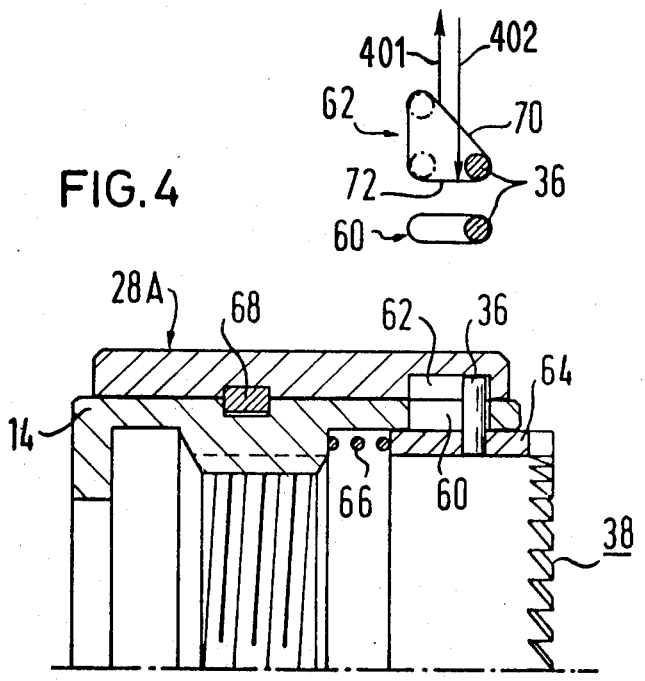

In the embodiment shown in FIG. 4 there is provided a double-slot guide, namely in the cap nut 14 an axially extending slot 60 and in the cap ring 28A a triangular recess 62. The stud screw 36 which serves as guide pin is in this case inserted in a sleeve 64 bearing the toothed ring 38 and passes through the slot 60 of the cap nut 14 into the recess 62 of the cap ring 28A. The sleeve 64 is displaceable with respect to the cap nut and the cap ring and is pressed by a compression coil spring 66 in an axial direction such that the stud screw 36 is pressed against the cap nut 14. The cap ring 28A is turnable with respect to the cap nut 14 but is axially locked by a snap ring 68 which engages in an outer groove of the cap nut 14 and an inner groove of the cap ring 28A.

In this embodiment not only the interlocking but also the unlocking take place automatically upon the screwing. If the cap ring 28A namely is turned in the direction indicated by the arrow 401, the pin rests against the paraxial shoulder of the recess and the cap nut is turned tight. The locking toothed ring 38 is in this connection automatically brought into engagement by the spring 66.

If on the other hand the cap ring 28A is turned in counterclockwise direction for the opening of the thread as indicated by the arrow 402, the pin 36 runs down on the oblique surface 70 and in this way the sleeve 64 is pulled back with it and thus the interlocking engagement of the toothed ring 38 is opened. This embodiment is particularly advisable when it is to be expected that the connector will not be operated by trained personnel. While in the embodiments of FIGS. 1 to 3 the operator must know that it is first of all necessary to pull back the cap ring, he need have no such knowledge when using the embodiment of FIG. 4 since the pulling back takes place automatically upon the commencement of the turning movement.

What is claimed is:

1. HF coaxial plug connector having a pin plug connector and a jack connector, one of which has a cap nut and the other an external thread onto which said cap nut can be screwed in the connected condition, and having an anti-turning device for said cap nut which comprises two toothed rings with rigid sawtooth toothing formed thereon, which rings can be brought into locking engagement with each other, said toothing of each said ring pointing toward the other said ring when said connectors are in the connected condition, and which rings are arranged on said cap nut and on said other connector, respectively in such manner as to be fixed against turning in either the locking or the unlocking direction when in the connected condition, one of said toothed rings being arranged on said cap nut and the other said toothed ring being fastened to said other connector, said one toothed ring being disengagable from said other toothed ring axially against a spring force, characterized by the fact that a cap ring is connected with said cap nut for causing said cap nut to rotate and that the other said toothed ring comprises teeth seated on a ring which is fastened to the opposing said connector; said other toothed ring being developed as an individual structural part adapted to be secured to conventional plug connectors.

2. A plug connection according to claim 1, characterized by the fact that said plug connector has a connecting flange and that said other toothed ring has a connecting flange which is secured by means of fastening screws to said connecting flange of said plug connector.

3. A plug connection according to claim 3, characterized by the fact that said fastening screws protrude from the side of said connecting flange of said other toothed ring which faces said one toothed ring, and that said ring which is a part of said other toothed ring has an axial length at least equal to the distance said fastening screws protrude beyond said side of said connecting flange of said other toothed ring.

4. A plug connection according to either of claims 1 or 3, characterized by the fact that said other toothed ring has four individual teeth which are equally spaced apart angularly.

5. A plug connection according to claim 1, characterized by the fact that a sleeve extension of the cap ring is guided in an axial annular groove of the cap nut.

6. A plug connection according to claim 5, characterized by the fact that a grip portion of said cap ring which protrudes from said sleeve extension is provided with a knurling.

7. A plug connection according to claim 5, characterized by the fact that the cap ring has a second outer sleeve extension which surrounds said cap nut on its outer side.

8. A plug connection according to any one of claims 1, 3 or 5, characterized by the fact that said cap ring has a pin and is guided in said cap nut by means of said pin which engages an L-shaped groove formed in said cap nut, said groove having an axially extending section and a section which extends in circumferential direction.

9. A plug connection according to any one of claims 1, 3 or 5, characterized by the fact that said cap ring has a pin and is guided in said cap nut by means of said pin which engages an axially extending groove formed in said cap nut.

10. A plug connection according to any one of claims 1, 3 or 5, characterized by the fact that upon turning of said cap ring in the unlocking direction said locking engagement is opened by axial backward guidance of said one toothed ring.

11. A plug connection according to claim 10, characterized by the fact that said cap ring is rotatable but is axially fixed with respect to said cap nut, that said one toothed ring is seated on a sleeve which is axially displaceable with respect to said cap ring and is axially supported by spring action, and that slot guide means is provided to guide said sleeve and said cap ring relative to each other.

12. A plug connection according to claim 11, characterized by the fact that said slot guide means comprises a pin which is fixed to said sleeve and engages, through an axial slot formed in said cap nut, a recess formed in said cap ring, said recess having a first shoulder parallel to the axis of said plug and an obliquely extending second shoulder.

13. A high frequency coaxial plug connector, comprising:

a pin plug connector;

a jack connector; one of said pin plug connector and said jack connector having an external thread and the other said connector having a cap nut adapted to be screwed onto said external thread;

a cap ring rotatable relative to said other connector and axially fixed relative thereof;

an anti-turning device for said cap nut, said anti-turning device comprising: an axially toothed sleeve having sawtooth toothing formed thereon and being received in said cap nut in an axially displaceable manner, and an axially toothed ring having sawtooth toothing formed thereon and being secured to said one connector; resilient means urging said toothed sleeve in an axial direction toward said one connector when said connectors are coupled together; said toothed ring and said toothed sleeve being adapted to engage each other in locking engagement to prevent rotation of said cap nut relative to said external thread when said connectors are coupled together; and slot guide means by means of which said sleeve and said cap ring engage each other, said slot guide means comprising a pin fixed to said sleeve, means defining an axially extending slot in said cap nut and means defining a recess in said cap ring, said pin passing through said axial slot and engaging said recess; and said recess having two walls coverging obliquely, one said wall being defined by an axially extending shoulder and the other said wall being defined by a second shoulder which forms an acute angle with said axially extending shoulder, said second shoulder being so oriented that rotation of said cap ring in the unlocking direction automatically effects axial retraction of said sleeve in a direction away from said other connector.

* * * * *